US011136789B2

(12) United States Patent
Colligan et al.

(10) Patent No.: US 11,136,789 B2
(45) Date of Patent: Oct. 5, 2021

(54) ANTI-LIGATURE DOOR HARDWARE WITH ENHANCED SAFETY FEATURES

(71) Applicant: Accurate Lock & Hardware Co. LLC, Stamford, CT (US)

(72) Inventors: Francis Colligan, New Haven, CT (US); Kevin T. Debacher, Bethel, CT (US)

(73) Assignee: Accurate Lock & Hardware Co. LLC, Stamford, CT (US)

( * ) Notice: Subject to any disclaimer, the term of this patent is extended or adjusted under 35 U.S.C. 154(b) by 110 days.

(21) Appl. No.: 16/728,988

(22) Filed: Dec. 27, 2019

(65) Prior Publication Data

US 2020/0208436 A1 Jul. 2, 2020

Related U.S. Application Data

(60) Provisional application No. 62/786,045, filed on Dec. 28, 2018.

(51) Int. Cl.

| | |
|---|---|
| ***E05B 47/00*** | (2006.01) |
| ***E05B 45/06*** | (2006.01) |
| ***G08B 5/36*** | (2006.01) |
| ***G07C 9/28*** | (2020.01) |
| ***G08B 21/02*** | (2006.01) |

(52) U.S. Cl.

CPC ..... *E05B 47/0001* (2013.01); *E05B 45/06* (2013.01); *G07C 9/28* (2020.01); *G08B 5/36* (2013.01); *G08B 21/02* (2013.01); *E05B 2047/0067* (2013.01); *E05B 2047/0069* (2013.01); *E05Y 2900/132* (2013.01)

(58) Field of Classification Search

CPC combination set(s) only.

See application file for complete search history.

(56) References Cited

U.S. PATENT DOCUMENTS

| | | | |
|---|---|---|---|
| 4,799,719 | A | 1/1989 | Wood |
| 6,012,310 | A | 1/2000 | Hsiao |
| 6,094,952 | A | 8/2000 | Clark et al. |
| 6,354,121 | B1 | 3/2002 | Frolov |
| 6,374,650 | B1 | 4/2002 | Newman |
| 6,471,257 | B1 | 10/2002 | Lu et al. |

(Continued)

FOREIGN PATENT DOCUMENTS

| | | |
|---|---|---|
| WO | WO3097969 A2 | 11/2003 |

*Primary Examiner* — Thomas S McCormack

(74) *Attorney, Agent, or Firm* — Forge IP, PLLC

(57) ABSTRACT

A door hardware assembly for a door having privacy and accessible sides includes a closing element moveable between a retracted position where the door is freely openable and an extended position where the door is maintained in a closed position when closed, and an actuator operably connected to the closing element, the actuator moving the closing element from the extended position to the retracted position upon receipt of an open command. At least one actuation sensor is provided on the privacy side of the door, causing the open command to be communicated to the actuator in response to an object being sensed within a threshold distance thereof, and at least one auxiliary sensor is provided on the privacy side of the door and providing at least one enhanced safety feature, the at least one auxiliary sensor being separate and distinct from the at least one actuation sensor.

28 Claims, 4 Drawing Sheets

(56) References Cited

U.S. PATENT DOCUMENTS

| | | | | |
|---|---|---|---|---|
| 7,051,561 | B2 | 5/2006 | Moon et al. | |
| 8,584,494 | B2 | 11/2013 | Salvatore et al. | |
| 8,887,542 | B2 | 11/2014 | Bogdanov et al. | |
| 8,931,315 | B2 | 1/2015 | Frolov et al. | |
| 9,580,931 | B2 | 2/2017 | Myers et al. | |
| 9,670,696 | B2 | 6/2017 | Chong | |
| 9,702,166 | B2 | 7/2017 | Zhang | |
| 2004/0112100 | A1 | 6/2004 | Martin | |
| 2004/0147817 | A1* | 7/2004 | Dewing | G16H 40/60 600/300 |
| 2009/0322473 | A1 | 12/2009 | Aliferis et al. | |
| 2010/0194563 | A1* | 8/2010 | Berner | G01G 19/52 340/545.1 |
| 2011/0068927 | A1* | 3/2011 | Berger | E05B 47/0046 340/573.1 |
| 2013/0186000 | A1* | 7/2013 | Gilchrist | E06B 1/528 49/13 |
| 2015/0159402 | A1 | 6/2015 | Yahav | |
| 2016/0343189 | A1* | 11/2016 | Dumas | G07C 9/00309 |
| 2018/0016836 | A1* | 1/2018 | Ibsies | E05B 41/00 |
| 2018/0313116 | A1 | 11/2018 | Criddle et al. | |
| 2018/0323632 | A1 | 11/2018 | Astarabadi | |
| 2019/0266862 | A1* | 8/2019 | Harrison | G08B 29/14 |

* cited by examiner

ANTI-LIGATURE DOOR HARDWARE WITH ENHANCED SAFETY FEATURES

FIELD OF THE INVENTION

The present invention relates to door hardware, and more specifically to door hardware having ligature resistant characteristics, in that it is difficult for ropes, cords, wires, articles of clothing or other pieces of material (hereinafter referred to as "ligatures") to be anchored to the door hardware, whether intentionally or unintentionally, to cause harm to persons having access thereto.

BACKGROUND OF THE INVENTION

In many environments, such as, for example, although not limited thereto, medical facilities, prisons, schools, offices, government buildings, residences, and other institutions, there exists a population of people at risk of committing suicide. In many psychiatric hospitals, for example, patients have been known to attempt suicide, specifically hanging, while in the care of the institution.

These suicide attempts are known to have involved the use of doorknobs, hinges and other door hardware, particularly since an effort is often made to remove other ligature anchor points from the facilities. Institutions have many private rooms where such a suicide attempt may take place, such as bathrooms. Every private room cannot be watched at the same time without enormous staff resources. Therefore, private rooms, and specifically door hardware in these rooms, provide an area of opportunity for a suicide attempt.

The problem of suicide attempts has been addressed in some institutions by simply removing all door hardware, and even the doors themselves. While this may reduce the opportunity for suicide attempts, it likewise eliminates all privacy and security. Many current designs for anti-suicide door hardware have focused thus far on streamlining the designs of the door knobs, latches, thumb turns, hinges, etc., to make them more difficult to use as anchor points for ligatures. However, little attention has been given thus far to removing door hardware, such as door knobs, entirely, but still allowing for privacy and security to be achieved.

What would be desirable instead would be door hardware that allows for a door to operate in much the same way that traditional doors operate (particularly, allowing for privacy and security), while at the same time obviating the need altogether for at least some of the traditional ligature anchor points, such as door knobs, levers, etc.

SUMMARY OF THE INVENTION

Accordingly, it is an object of the present invention to provide a door hardware assembly that allows for a door to operate in much the same way that traditional doors operate (particularly, allowing for privacy and security), while at the same time obviating the need altogether for at least some of the traditional ligature anchor points, such as door knobs, levers, etc.

It is a further object of the present invention to provide a door hardware assembly of this type which further includes safety features enhancing the safety of those living and working in the facility where the door hardware is installed.

These and other objectives are achieved, in accordance with a first aspect of the invention, by providing a door hardware assembly for a door having a privacy side and an accessible side, the door hardware assembly including a closing element moveable between a retracted position wherein the door is freely openable and an extended position wherein the door is maintained in a closed position when closed, and an actuator operably connected to the closing element, the actuator moving the closing element from the extended position to the retracted position upon receipt of an open command. At least one actuation sensor is provided on the privacy side of the door, the at least one actuation sensor causing the open command to be communicated to the actuator in response to an object being sensed within a threshold distance of the at least one actuation sensor. Additionally, at least one auxiliary sensor is provided on the privacy side of the door and providing at least one enhanced safety feature, the at least one auxiliary sensor being separate and distinct from the at least one actuation sensor.

In some embodiments, the closing element comprises a latch, a deadbolt or both a latch and a deadbolt. In some embodiments, the actuator comprises at least one electric motor. In some embodiments, the at least one actuation sensor comprises a touch activated sensor such that the threshold distance essentially equals zero. In certain of these embodiments, the at least one actuation sensor comprises a proximity sensor. In certain embodiments, the threshold distance falls within a range of from 6 inches to 36 inches.

In some embodiments, the at least one auxiliary sensor comprises a plurality of auxiliary proximity sensors. In certain of these embodiments, the plurality of auxiliary proximity sensors are arranged in at least one row. In certain embodiments, the at least one row comprises two rows, a first row being disposed within 12 inches from a bottom of the door, and a second row being disposed at a height within a range of from one-third to two-thirds of a total height of the door.

In some embodiments, the at least one auxiliary sensor, upon detection of a person within a threshold distance thereof for at least a threshold amount of time, causes the open command to be communicated to the actuator, whereby the at least one auxiliary sensor provides protection against suicide attempts. In some embodiments, the at least one auxiliary sensor, upon detection of a person within a threshold distance thereof when the door is already open, causes a warning device to be activated, whereby the at least one auxiliary sensor provides protection against ambush for those entering the door. In certain of these embodiments, the warning device comprises a light disposed on the accessible side of the door.

In some embodiments, the at least one auxiliary sensor, upon detection of an object within a threshold distance thereof for at least a threshold amount of time, causes a warning device to be activated, whereby the at least one auxiliary sensor provides notification of a barricade situation. In certain of these embodiments, the warning device comprises at least one of a light disposed on the accessible side of the door, a mobile device and a computer display disposed outside the door.

In some embodiments, an exterior actuation sensor is disposed on the accessible side of the door, the exterior actuation sensor causing the open command to be communicated to the actuator in response to an object being sensed within a threshold distance of the exterior actuation sensor. In certain of these embodiments, a locking mechanism is disposed on the privacy side of the door, the locking mechanism, when activated, disabling the exterior actuation sensor. In certain embodiments, a lock override mechanism is disposed on the accessible side of the door, the lock override mechanism, when activated, overriding the locking mechanism, whereby the exterior actuation sensor is enabled despite activation of the locking mechanism.

In accordance with another aspect of the present invention, a door having a privacy side and an accessible side includes door hardware comprising a closing element moveable between a retracted position wherein the door is freely openable and an extended position wherein the door is maintained in a closed position when closed, and an actuator operably connected to the closing element, the actuator moving the closing element from the extended position to the retracted position upon receipt of an open command. A touch sensor provided on the privacy side of the door causes the open command to be communicated to the actuator in response to an object coming in contact with the touch sensor. A plurality of proximity sensors are provided on the privacy side of the door and providing at least one enhanced safety feature, the plurality of proximity sensors being separate and distinct from the touch sensor. The plurality of proximity sensors, upon detection of a person within a threshold distance thereof for at least a threshold amount of time, causes the open command to be communicated to the actuator, whereby the plurality of proximity sensors provides protection against suicide attempts.

In some embodiments, the closing element comprises a latch, a deadbolt or both a latch and a deadbolt. In some embodiments, the actuator comprises at least one electric motor. In some embodiments, the plurality of proximity sensors are arranged in at least one row. In certain of these embodiments, the at least one row comprises two rows, a first row being disposed within 12 inches from a bottom of the door, and a second row being disposed at a height within a range of from one-third to two-thirds of a total height of the door.

In some embodiments, the plurality of proximity sensors, upon detection of a person within a threshold distance thereof when the door is already open, causes a warning device to be activated, whereby the plurality of proximity sensors provides protection against ambush for those entering the door. In certain of these embodiments, the warning device comprises a light disposed on the accessible side of the door.

In some embodiments, the plurality of proximity sensors, upon detection of an object within a threshold distance thereof for at least a threshold amount of time, causes a warning device to be activated, whereby the plurality of proximity sensors provides notification of a barricade situation. In certain of these embodiments, the warning device comprises at least one of a light disposed on the accessible side of the door, a mobile device and a computer display disposed outside the door.

In some embodiments, an exterior touch sensor is disposed on the accessible side of the door, the exterior touch sensor causing the open command to be communicated to the actuator in response to an object coming in contact with the exterior touch sensor. In certain of these embodiments, a locking mechanism is disposed on the privacy side of the door, the locking mechanism, when activated, disabling the exterior touch sensor. In certain embodiments, a lock override mechanism is disposed on the accessible side of the door, the lock override mechanism, when activated, overriding the locking mechanism, whereby the exterior touch sensor is enabled despite activation of the locking mechanism.

Other objects of the invention and its particular features and advantages will become more apparent from consideration of the following drawings and accompanying detailed description.

DETAILED DESCRIPTION OF THE INVENTION

Generally, the present invention provides door hardware that employs touch switching technology (e.g., where the resistance of a person's body touching a switch plate or the like opens and/or closes a switch) and/or proximity switching technology (e.g., where the presence of a person's body part within a threshold distance of a sensor opens and/or closes a switch) in combination with auto latch retraction (e.g., where one or more motors and/or solenoids causes retraction and/or extension of a door latch and/or deadbolt) in order to provide a door that can be locked and unlocked as can a standard door, but without the need for a door knob, lever or like mechanism that protrudes from the face of the door. As will be recognized by those skilled in the art, it is impossible, or nearly so, to use a flat metal plate and/or a recessed proximity sensor that is substantially flush with a face of a door as an anchor point for a ligature.

Exemplary embodiments of the present invention will now be described with reference to the drawings. It should be understood that, although the exemplary embodiments discussed herein are configured as mortise lock assemblies, such is not strictly necessary, and that the present invention may instead be configured as a different type of lock assembly, such as a bored cylinder lock assembly.

Figure 1A:
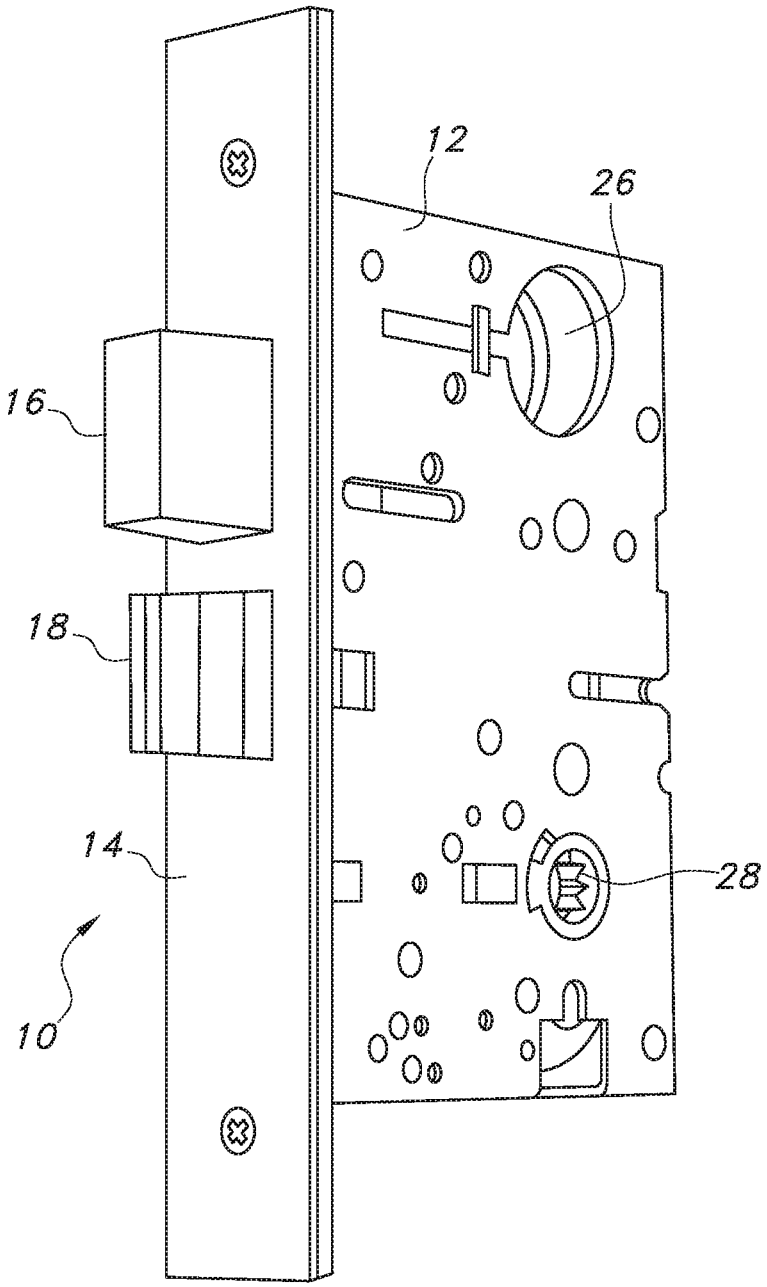
FIG. 1*a* is a side isometric view of an exemplary mortise lock assembly that may be adapted to incorporate the features of the present invention.

FIG. 1*a* shows a traditional mortise lock assembly (10). In the embodiment shown, the assembly (10) is designed for installation in a mortise (or pocket) formed in a door. Mortises are most often formed using a mortise jig or other appropriate device. The assembly (10) comprises a lock body (12), which serves as a kind of housing for the majority of the components of the assembly (10). Sometimes, the lock body is referred to as a lock case. A faceplate (14) is secured to the lock body (12). The faceplate (14) closes the side of the lock body (12) that is accessible from the side of the door and the faceplate (14) is the portion of the assembly (10) that is visible on the side of the door.

The faceplate (14) has openings for the deadbolt (16) and a latch (18). The deadbolt (16) is shown in its extended position in FIG. 1*a,* in which, if the assembly (10) were installed in a door, the deadbolt (16) would protrude through an opening in the faceplate (14) to lock the door.

Figure 1B:
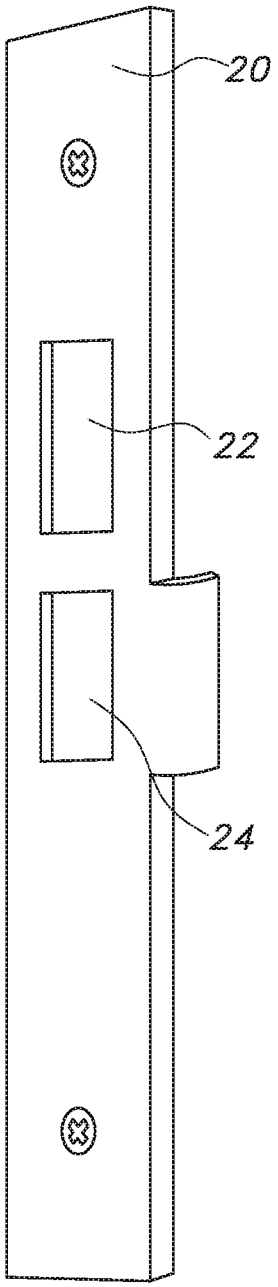
FIG. 1*b* is a side isometric view of an exemplary door strike that may be used with the mortise lock assembly of FIG. 1*a*.

FIG. 1*b* shows an exemplary strike plate (20). The strike plate (20) is typically installed on the inside surface of the doorframe. The strike plate (20) has an opening (22) for receiving the deadbolt (16) and an opening (24) for receiving the latch (18). Although not shown in the figures, corresponding holes are cut in the doorframe to accommodate the deadbolt (16) and latch (18) when the door is closed and locked.

The lock body (12) also includes a circular opening or cylinder port (26) for accommodating a lock cylinder (not shown in FIG. 1*a*). As is known in the art, the lock cylinder interacts with the deadbolt (16) to move it between the extended position shown in FIG. 1*a* and a retracted position. Traditionally, the deadbolt lock cylinder requires use of a key on at least one side of the door to turn the lock. (In some traditional embodiments, both sides of the lock cylinder require use of a key to turn the lock cylinder).

The lock body (12) also includes a follower hole (28), which is adapted to accommodate a spindle (not shown). The spindle connects a follower (not shown) to a door handle (not shown). When the door handle is turned, the spindle rotates the follower, which imparts lateral movement to the latch (18). The latch (18) can be moved between an extended position (as shown in FIG. 1*a*) and a retracted position.

Figure 2:
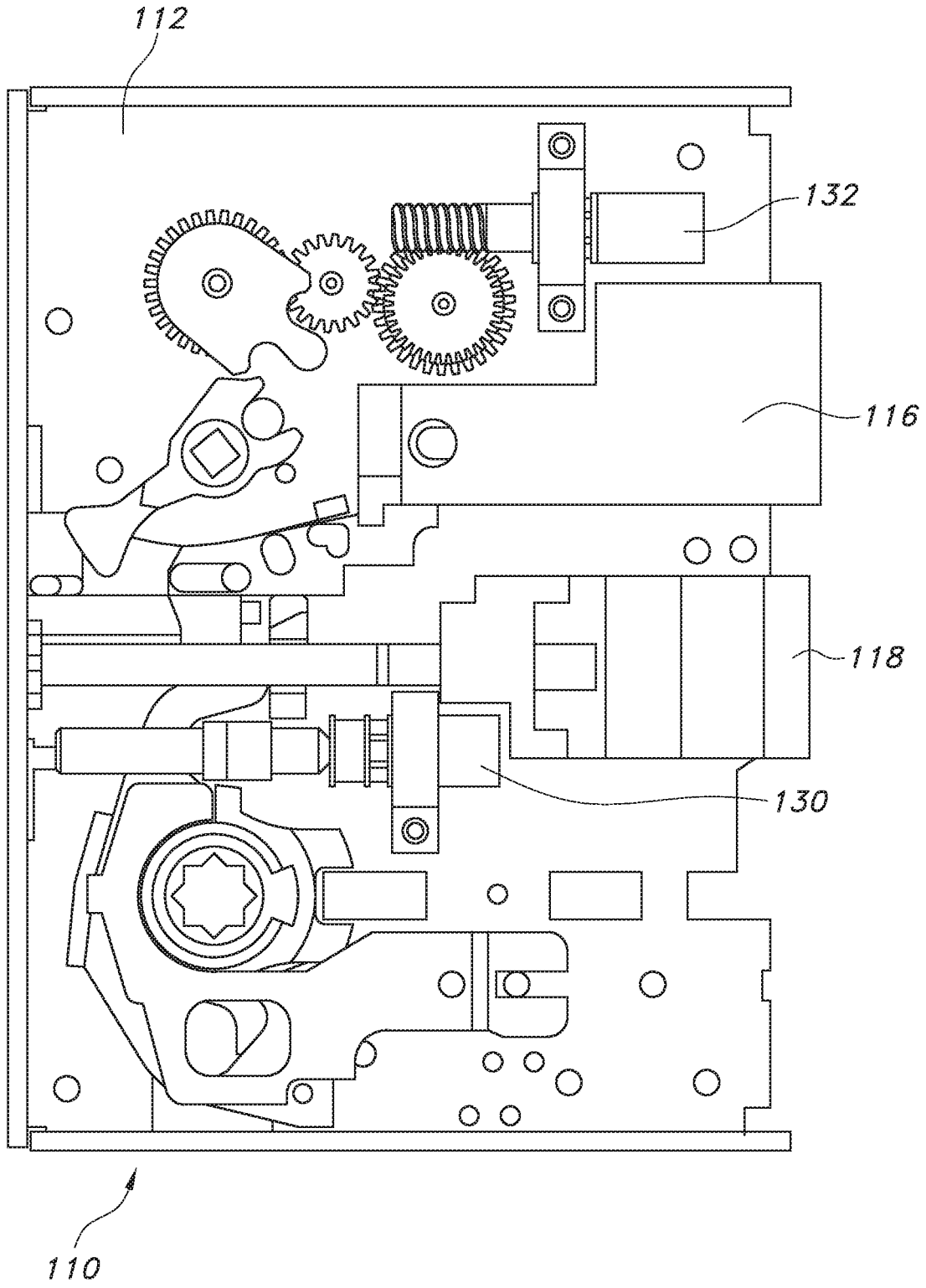
FIG. 2 is a side partially cut away view of the exemplary mortise lock assembly of FIG. 1*a* that has been adapted to incorporate two internal motors in accordance with the present invention.

Turning now to FIG. 2, a mortise lock assembly (110) particularly suited for use with the present invention is shown. The main difference between the inventive assembly (110) and the traditional assembly (10) is that the inventive assembly (110) includes a least one motor and/or solenoid that is employed to retract the latch (118) and/or the deadbolt (116).

In the exemplary embodiment shown in FIG. 2, it is envisioned that the latch motor (130) is configured, on command, to retract the latch (118) and also to retract the deadbolt (116), if the deadbolt (116) is extended. It is also envisioned that the deadbolt motor (132) is configured, on command, to extend the deadbolt (116) if it had been retracted. However, the particular functions of the motor(s) may vary to some degree, as desired, without departing from the spirit of the invention.

As mortise lock assemblies having one or more electric motors disposed within the lock bodies thereof (in similar fashion to FIG. 2) are well knows, as are the internal mechanisms for actuation of the latch and deadbolt, a detailed description thereof is not presented herein. Numerous designs of this type will be readily apparent to those having ordinary skill in the art and the particulars of those designs form no part of the present invention.

Figure 3:
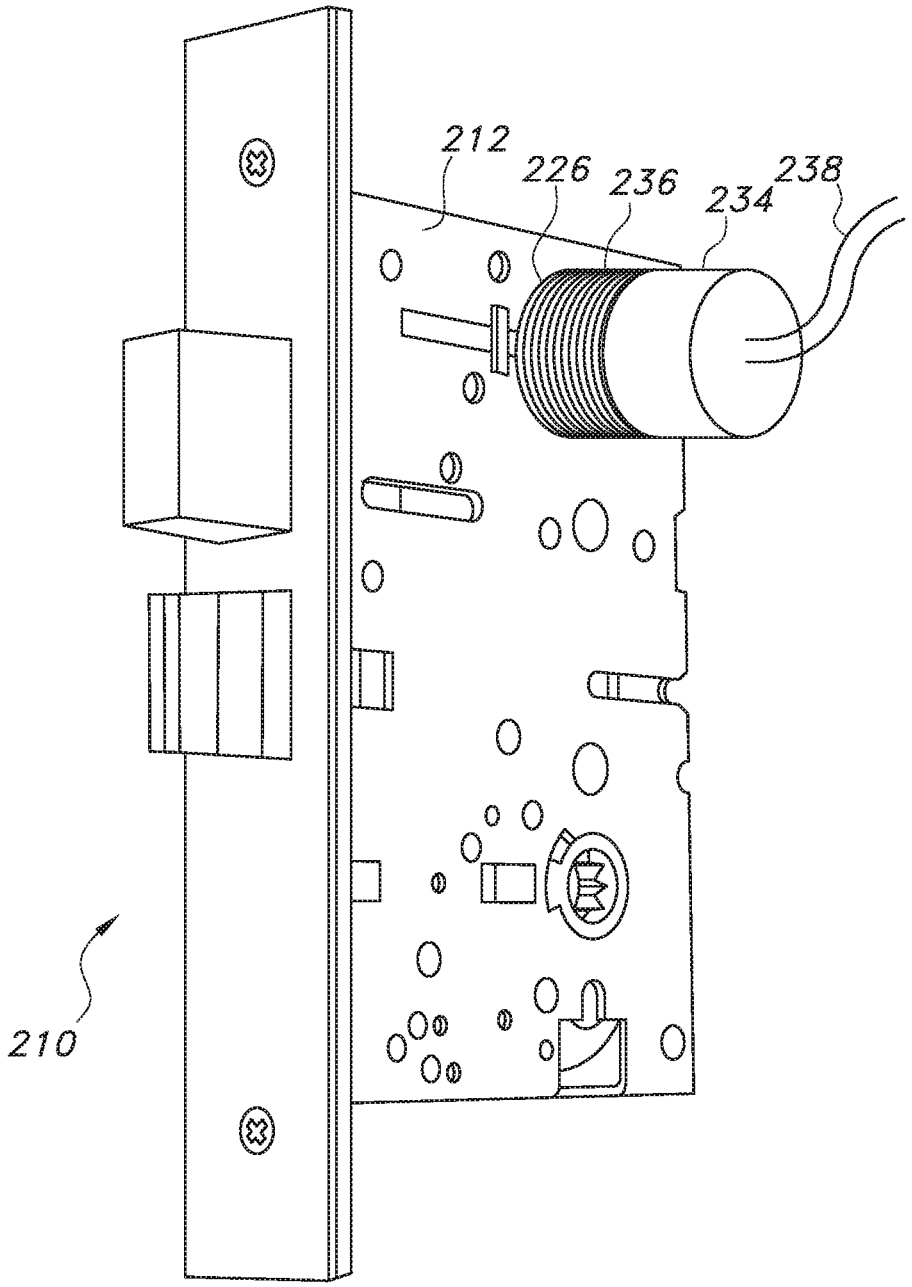
FIG. 3 is a side isometric view of the exemplary mortise lock assembly of FIG. 1 a that has been adapted to incorporate an external motorized cylinder in accordance with the present invention.

In the particular embodiment shown in FIG. 2, there are shown two motors—one latch motor (130) and one deadbolt motor (132), both of which are shown to be disposed within the lock body (112). However, if desired, one or both of the motors may be disposed external to the lock body, as shown in connection with the mortise lock assembly (210) of FIG. 3, where deadbolt motor (234) is disposed in a cylinder externally attached to the lock body (212). In this embodiment, the external deadbolt motor (234) is provided with external male threads (236) that cooperate with internal female threads formed in circular opening or cylinder port (226) of the lock body (212). Wire leads (238) are shown for providing power to the external deadbolt motor (234), but in other respects, the mortise lock assembly (210) of FIG. 3 is similar to the mortise lock assembly (10) of FIG. 1.

With respect to mortise lock assemblies having one or more electric motors disposed outside of the lock bodies thereof (in similar fashion to FIG. 3), again, various configurations will be readily apparent to those having ordinary skill in the art, and as such, a detailed description thereof is not presented herein. It is worth noting that one option for a motorized lock cylinder that may be used in connection with the present invention is described in detail in U.S. Provisional Patent Application No. 62/785,562, filed by the Applicant hereof on Dec. 27, 2018 (along with a corresponding utility patent application also being filed), the contents of which are hereby incorporated by reference herein.

Figure 4B:
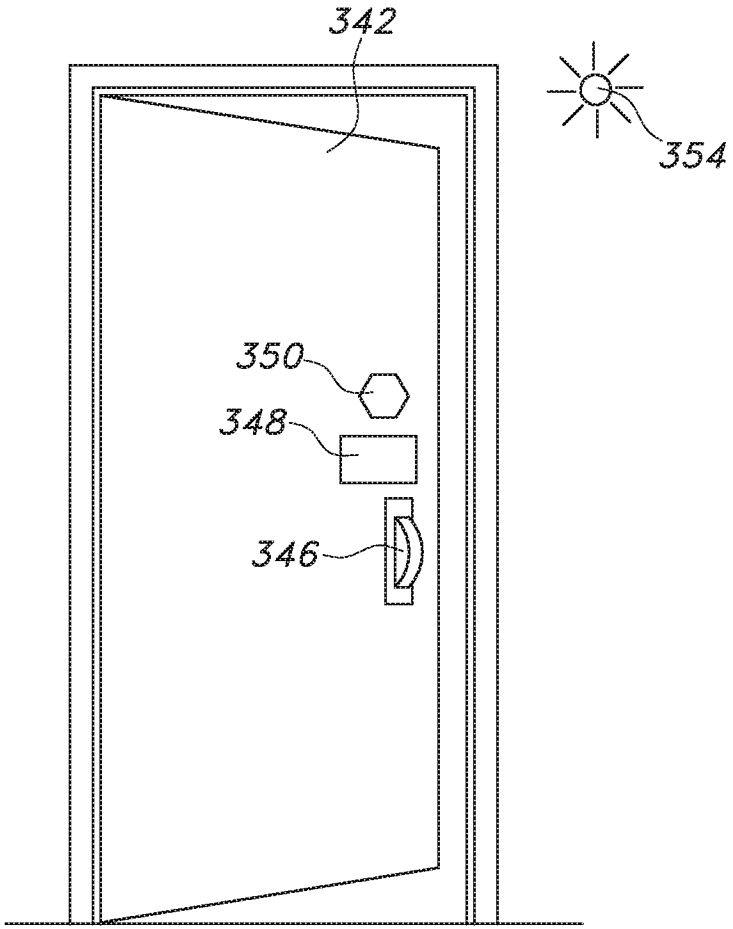
FIGS. 4*a* and 4*b* are side isometric views illustrating the privacy side and the accessible side, respectively, of a door in accordance with aspects of the present invention.
Figure 4A:
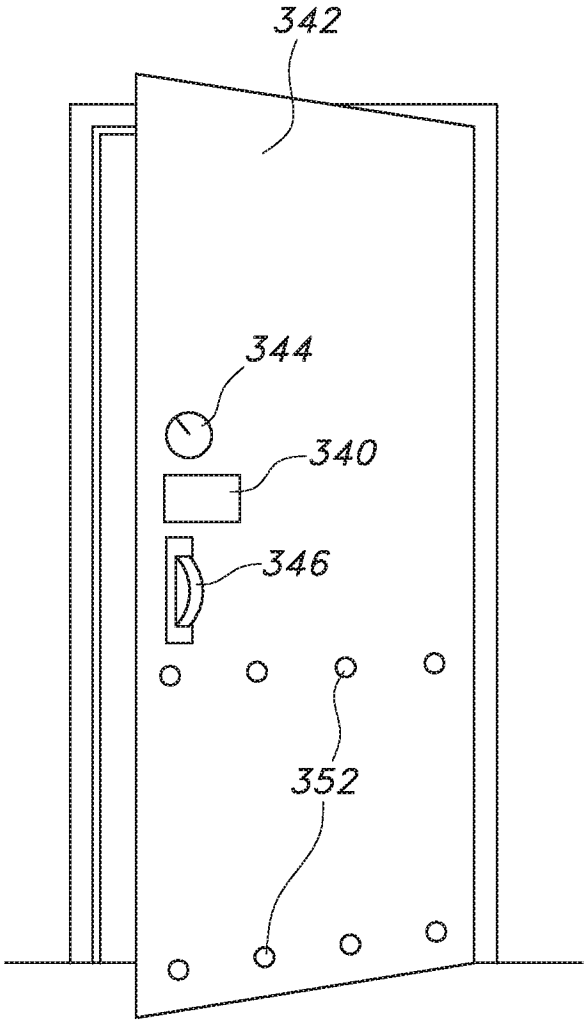

Referring now to FIGS. 4*a* and 4*b*, regardless of the specific configuration, the motor(s) (130, 132, 234) can be actuated by way of at least one actuation sensor (340), which detects the presence of an object (such as an object being held by a person, a person's hand, arm, foot or other body part, etc.) within a threshold distance at least on the privacy side (i.e., the inside) of the door (342), as shown specifically in FIG. 4*a*.

The actuation sensor(s) (340) may take the form of one or more touch activation sensors, meaning that physical contact with the actuation sensor(s) (340) is required before the presence of the object is detected (i.e., the threshold distance between the object and the sensor is effectively zero). Such touch activated sensors, which have become relatively common recently in the context of sink faucets, generally rely on a sensed change in resistance when a person touches a conductive plate or the like in order to open/close a switch. Such a plate may be generally flush with the surface of the door, or at most, protrude from the face of the door by a very small amount (e.g., 1/16"). As such, the touch activated sensor plate(s) provide substantially no means for a ligature to be attached to the door, but allow for controlled actuation (i.e., extension and/or retraction) of the latch and/or deadbolt.

Instead of a touch activated sensor, the actuation sensor(s) (340) may take the form of one or more proximity sensor(s) that do not require physical contact therewith in order to sense the presence of an object. Any of various proximity sensors that are well known, for example on the bumpers of motor vehicles to sense the distance of relatively near objects, may be employed. As but one example, it has been found that laser-ranging time-of-flight (ToF) type sensors provide excellent results. As of the filing date hereof, one such sensor is the Model No. VL53L1X Time-of-Flight sensor distributed by STMicroelectronics, NV of Geneva, Switzerland. As with the touch activated sensors described above, such laser-ranging ToF type sensors may be generally flush with the surface of the door, or at most, protrude from the face of the door by a very small amount (e.g., 1/16"). As such, the laser-ranging ToF type sensors provide substantially no means for a ligature to be attached to the door, but allow for controlled actuation (i.e., extension and/or retraction) of the latch and/or deadbolt.

If desired, a locking mechanism (344) may also be provided on the inside (i.e., privacy side) of the door (342) to "lock" the door, for example, by disabling power to the motor(s) and/or causing the sensor(s) (340) to ignore commands. Such locking mechanism (344) may take the form of, for example, another touch activated sensor, an anti-ligature thumb turn (such as described in U.S. Pat. No. 8,584,494, which is hereby incorporated by reference in its entirety), or some other ligature resistant mechanism. Thus, the inventive door hardware allows for privacy and security similar to that afforded by traditional door hardware.

If desired, the pull side of the door (342) (e.g., the side on which are mounted the hinges) may also be provided with a ligature resistant handle (346), such as a crescent shaped handle similar to that illustrated in U.S. Pat. No. 8,584,494, or of a handle having some other ligature resistant shape to facilitate opening of the door in the pull direction.

Turning now specifically to FIG. 4*b*, illustrated is the accessible side (i.e., the outside or the side opposite to the aforementioned privacy side) of the door (342). If desired, the accessible side of the door (342) may also include at least one actuation sensor (348), which detects the presence of an object (such as an object being held by a person, a person's hand, arm, foot or other body part, etc.) within a threshold distance. As with the actuation sensor (340), the actuation sensor (348) on the accessible side of the door (342) may take the form of a touch activated sensor, a laser-ranging time-of-flight (ToF) type sensor, or some other type of sensor detecting the presence of an object within a threshold distance.

If desired, a lock override mechanism (350) may also be provided on the accessible side (i.e., the outside) of the door (342) to override the "lock" function activated by the locking mechanism (344) on the privacy side, if provided. The lock override mechanism (350) may take several forms, such as for example, a keyed cylinder, a key pad, a key fob reader or the like, to allow for the privacy "lock" function to be overridden, but only by authorized personnel.

If desired, the push side of the door (342) (e.g., the side opposite to which are mounted the hinges) may also be provided with a ligature resistant handle (346), such as a crescent shaped handle similar to that illustrated in U.S. Pat. No. 8,584,494, or of a handle having some other ligature resistant shape to facilitate closing of the door.

With reference again to FIG. 4*a*, the privacy side of the door (342) is further provided with at least one, but preferably a plurality of, auxiliary proximity sensors (352). It is contemplated that these auxiliary proximity sensors (352) may serve a variety of purposes, as will now be described.

As is known, room occupants may still attempt suicide using the doors to their rooms even if ligature points are removed from the door hardware itself, for example, by tying a knot in a bedsheet, rope or the like, and then closing the door with the knot on the outside of the door. Once the door is latched and/or deadbolted in a closed position, the knot thus acts as an anchor. The occupant may then wrap the bedsheet or rope around his/her neck and either attempt to hang himself/herself (if the knot is positioned along the top edge of the door) or choke himself/herself by doing a so-called "alligator roll" (if the knot is positioned along the bottom edge of the door).

The auxiliary proximity sensors (352) may be used to sense the presence of a person attempting to hang and/or choke himself/herself. In this regard, the auxiliary proximity sensors (352) may be strategically located to maximize the likelihood that a suicidal person is detected. For example, as shown in FIG. 4*a*, a row of auxiliary proximity sensors (352) (a row of four sensors is shown) may be disposed along a bottom edge of the door (say within 12 inches of the bottom edge) in order to detect the presence of an occupant attempting to choke himself/herself by doing an "alligator roll", and/or a row of auxiliary proximity sensors (352) (again, a row of four sensors is shown) may be disposed toward the middle of the door (say within the middle one-third of the height of the door) in order to detect the presence of an occupant attempting to hang himself/herself from the top of the door.

When/if a suspected attempted suicide is detected by the auxiliary proximity sensors (352), the motor(s) (130, 132, 234) are automatically actuated, even if the at least one actuation sensor (340) has not been activated, Once the door is no longer latched and/or deadbolted in the closed position, the forces on the knot of the bedsheet, rope, etc. will cause the door to open and the knot to be released, such that it no longer acts as an anchor.

If desired, a time delay may be introduced before the auxiliary proximity sensors (352) automatically trigger opening of the door in order to reduce the likelihood of erroneous suicide attempt detections and consequent unintentional door openings. Of course, however, the time delay should not be so long that an attempted suicide is likely to be successful.

Instead or in addition, the auxiliary proximity sensors (352) may be used to sense the presence of a person hiding behind an open door. In certain environments, it has been known for room occupants to hide behind an open door in order to surprise, and possibly ambush/attack, another person entering the room. The auxiliary proximity sensors (352) may be used to detect the possible presence of a person hiding behind an open door, and provide a warning to those entering the room. For example, a light (354) or the like may be provided on the outside of the room (see FIG. 4*b*), which would alert those entering the room to exhibit some caution when entering, so that they are not surprised by a person hiding behind the door.

As another option, the auxiliary proximity sensors (352) may be used to sense the presence of objects positioned behind a closed door that are being used to barricade the door. Again, a time delay may be involved so as to reduce the likelihood of false alarms, but once it is determined that a likely barricade situation has occurred, a warning may be provided. For example, as before, a light (354) or the like may be provided on the outside of the room (see FIG. 4*b*), which would alert those outside the room that the door has possibly been barricaded closed. Instead or in addition, an alert may be provided to a remote device, such as a computer at a guard or nurse's station, a mobile device carried by a guard, nurse or the like, etc.

As with the actuation sensors (340, 348) discussed above, the auxiliary proximity sensors (352) may take the form of laser-ranging time-of-flight (ToF) type sensors, or some other type of sensor detecting the presence of an object within a threshold distance. Also as discussed above, as of the filing date hereof, one example of an appropriate sensor is the Model No. VL53L1X Time-of-Flight sensor distributed by STMicroelectronics, NV of Geneva, Switzerland. Such laser-ranging ToF type sensors may be generally flush with the surface of the door, or at most, protrude from the face of the door by a very small amount (e.g., 1/16"). As such, the laser-ranging ToF type sensors provide substantially no means for a ligature to be attached to the door, but allow for controlled actuation (i.e., extension and/or retraction) of the latch and/or deadbolt. Additionally, such sensors advantageously provide adjustability for object proximity threshold before being triggered, which may range, for example, between 6 inches and 36 inches. This flexibility allows for optimization of object sensing, while at the same time minimizing the occurrence of "false alarms."

With respect to power for the motors, sensors, etc., various mechanisms are contemplated. If one or more AC motors is employed, a wired connection to mains power through the door and the door frame may be provided. However, when one or more DC motors is employed (as is generally preferred), various options exist. For example, a wired connection to mains power could be used with an AC/DC transformer, though such may not be optimal. Alternately, replaceable batteries could be employed, using single use or rechargeable batteries that must be replaced by a user.

However, a preferred option may be to employ a rechargeable battery disposed in the door that is electrically connected to a power jump positioned between the door and the door frame. This would allow for the battery to be slowly charged at very low power (typically lower than would be required to extend/retract the latch and/or the deadbolt) while the door is closed, without requiring a wired connection between the door frame and the door. Then, when commanded, the battery could provide a surge of power at a level needed in order to extend/retract the latch and/or the deadbolt. Such an arrangement provides for reliable operation and ease of use.

Also, for the sake of safety, it may be desired to provide a back-up capacitor or the like, so that in the case of failure of the primary power supply, the back-up capacitor could be employed to retract the deadbolt and the latch, such that the door hardware fails open, thereby reducing the risk of accidental trapping of persons within a room, building, etc.

The present invention thus provides door hardware that allows for a door to operate in much the same way that traditional doors operate (particularly, allowing for privacy and security), while at the same time obviating the need altogether for at least some of the traditional ligature anchor points, such as door knobs, levers, etc. and allowing for enhanced safety features.

What is claimed is:

1. A door hardware assembly for a door having a privacy side and an accessible side, said door hardware assembly comprising:

a closing element moveable between a retracted position wherein the door is freely openable and an extended position wherein the door is maintained in a closed position when closed;

an actuator operably connected to said closing element, said actuator moving said closing element from the extended position to the retracted position upon receipt of an open command;

at least one actuation sensor provided on the privacy side of the door, said at least one actuation sensor causing the open command to be communicated to said actuator in response to an object being sensed within a threshold distance of said at least one actuation sensor; and at least one auxiliary sensor provided on the privacy side of the door and providing at least one enhanced safety feature, said at least one auxiliary sensor being separate and distinct from said at least one actuation sensor;

wherein said at least one auxiliary sensor, upon detection of a person within a threshold distance thereof for at least a threshold amount of time, causes the open command to be communicated to said actuator, whereby said at least one auxiliary sensor provides protection against suicide attempts.

2. The assembly according to claim 1 wherein said closing element comprises a latch, a deadbolt or both a latch and a deadbolt.

3. The assembly according to claim 1 wherein said actuator comprises at least one electric motor.

4. The assembly according to claim 1 wherein said at least one actuation sensor comprises a touch activated sensor such that the threshold distance essentially equals zero.

5. The assembly according to claim 4 wherein said at least one actuation sensor comprises a proximity sensor.

6. The assembly according to claim 5 wherein said threshold distance falls within a range of from 6 inches to 36 inches.

7. The assembly according to claim 1 wherein said at least one auxiliary sensor comprises a plurality of auxiliary proximity sensors.

8. The assembly according to claim 7 wherein said plurality of auxiliary proximity sensors are arranged in at least one row.

9. A door hardware assembly for a door having a privacy side and an accessible side, said door hardware assembly comprising:

a closing element moveable between a retracted position wherein the door is freely openable and an extended position wherein the door is maintained in a closed position when closed;

an actuator operably connected to said closing element, said actuator moving said closing element from the extended position to the retracted position upon receipt of an open command;

at least one actuation sensor provided on the privacy side of the door, said at least one actuation sensor causing the open command to be communicated to said actuator in response to an object being sensed within a threshold distance of said at least one actuation sensor; and at least one auxiliary sensor provided on the privacy side of the door and providing at least one enhanced safety feature, said at least one auxiliary sensor being separate and distinct from said at least one actuation sensor;

wherein said at least one auxiliary sensor comprises a plurality of auxiliary proximity sensors arranged in at least two rows, a first row being disposed within 12 inches from a bottom of the door, and a second row being disposed at a height within a range of from one-third to two-thirds of a total height of the door.

10. A door hardware assembly for a door having a privacy side and an accessible side, said door hardware assembly comprising:

a closing element moveable between a retracted position wherein the door is freely openable and an extended position wherein the door is maintained in a closed position when closed;

an actuator operably connected to said closing element, said actuator moving said closing element from the extended position to the retracted position upon receipt of an open command;

at least one actuation sensor provided on the privacy side of the door, said at least one actuation sensor causing the open command to be communicated to said actuator in response to an object being sensed within a threshold distance of said at least one actuation sensor; and at least one auxiliary sensor provided on the privacy side of the door and providing at least one enhanced safety feature, said at least one auxiliary sensor being separate and distinct from said at least one actuation sensor;

wherein said at least one auxiliary sensor, upon detection of a person within a threshold distance thereof when the door is already open, causes a warning device to be activated, whereby said at least one auxiliary sensor provides protection against ambush for those entering the door.

11. The assembly according to claim 10 wherein the warning device comprises a light disposed on the accessible side of the door.

12. A door hardware assembly for a door having a privacy side and an accessible side, said door hardware assembly comprising:

a closing element moveable between a retracted position wherein the door is freely openable and an extended position wherein the door is maintained in a closed position when closed;

an actuator operably connected to said closing element, said actuator moving said closing element from the extended position to the retracted position upon receipt of an open command;

at least one actuation sensor provided on the privacy side of the door, said at least one actuation sensor causing the open command to be communicated to said actuator in response to an object being sensed within a threshold distance of said at least one actuation sensor; and at least one auxiliary sensor provided on the privacy side of the door and providing at least one enhanced safety feature, said at least one auxiliary sensor being separate and distinct from said at least one actuation sensor;

wherein said at least one auxiliary sensor, upon detection of an object within a threshold distance thereof for at least a threshold amount of time, causes a warning device to be activated, whereby said at least one auxiliary sensor provides notification of a barricade situation.

13. The assembly according to claim 12 wherein the warning device comprises at least one of a light disposed on the accessible side of the door, a mobile device and a computer display disposed outside the door.

14. The assembly according to claim 1 further comprising an exterior actuation sensor disposed on the accessible side of the door, the exterior actuation sensor causing the open command to be communicated to said actuator in response to an object being sensed within a threshold distance of said exterior actuation sensor.

15. The assembly according to claim 14 further comprising a locking mechanism disposed on the privacy side of the door, the locking mechanism, when activated, disabling the exterior actuation sensor.

16. The assembly according to claim 15 further comprising a lock override mechanism disposed on the accessible side of the door, the lock override mechanism, when activated, overriding the locking mechanism, whereby the exterior actuation sensor is enabled despite activation of the locking mechanism.

17. A door having a privacy side and an accessible side, said door including door hardware comprising:

a closing element moveable between a retracted position wherein the door is freely openable and an extended position wherein the door is maintained in a closed position when closed;

an actuator operably connected to said closing element, said actuator moving said closing element from the extended position to the retracted position upon receipt of an open command;

a touch sensor provided on the privacy side of the door, said touch sensor causing the open command to be communicated to said actuator in response to an object coming in contact with said touch sensor;

a plurality of proximity sensors provided on the privacy side of the door and providing at least one enhanced safety feature, said plurality of proximity sensors being separate and distinct from said touch sensor; and wherein said plurality of proximity sensors, upon detection of a person within a threshold distance thereof for at least a threshold amount of time, causes the open command to be communicated to said actuator, whereby said plurality of proximity sensors provides protection against suicide attempts.

18. The assembly according to claim 17 wherein said closing element comprises a latch, a deadbolt or both a latch and a deadbolt.

19. The assembly according to claim 17 wherein said actuator comprises at least one electric motor.

20. The assembly according to claim 17 wherein said plurality of proximity sensors are arranged in at least one row.

21. The assembly according to claim 20 wherein said at least one row comprises two rows, a first row being disposed within 12 inches from a bottom of the door, and a second row being disposed at a height within a range of from one-third to two-thirds of a total height of the door.

22. The assembly according to claim 17 wherein said plurality of proximity sensors, upon detection of a person within a threshold distance thereof when the door is already open, causes a warning device to be activated, whereby said plurality of proximity sensors provides protection against ambush for those entering the door.

23. The assembly according to claim 22 wherein the warning device comprises a light disposed on the accessible side of the door.

24. The assembly according to claim 17 wherein said plurality of proximity sensors, upon detection of an object within a threshold distance thereof for at least a threshold amount of time, causes a warning device to be activated, whereby said plurality of proximity sensors provides notification of a barricade situation.

25. The assembly according to claim 24 wherein the warning device comprises at least one of a light disposed on the accessible side of the door, a mobile device and a computer display disposed outside the door.

26. The assembly according to claim 17 further comprising an exterior touch sensor disposed on the accessible side of the door, the exterior touch sensor causing the open command to be communicated to said actuator in response to an object coming in contact with said exterior touch sensor.

27. The assembly according to claim 26 further comprising a locking mechanism disposed on the privacy side of the door, the locking mechanism, when activated, disabling the exterior touch sensor.

28. The assembly according to claim 27 further comprising a lock override mechanism disposed on the accessible side of the door, the lock override mechanism, when activated, overriding the locking mechanism, whereby the exterior touch sensor is enabled despite activation of the locking mechanism.

* * * * *